US009598251B2

(12) United States Patent
Miyazaki et al.

(10) Patent No.: US 9,598,251 B2
(45) Date of Patent: Mar. 21, 2017

(54) IMAGE FORMING APPARATUS

(71) Applicant: KYOCERA Document Solutions Inc., Osaka (JP)

(72) Inventors: Masahiko Miyazaki, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/200,365

(22) Filed: Jul. 1, 2016

(65) Prior Publication Data

US 2017/0015516 A1 Jan. 19, 2017

(30) Foreign Application Priority Data

Jul. 16, 2015 (JP) ..... 2015-142182

(51) Int. Cl.
*B65H 5/00* (2006.01)
*B65H 5/36* (2006.01)
(Continued)

(52) U.S. Cl.
CPC ..... *B65H 5/36* (2013.01); *B65H 5/068* (2013.01); *B65H 29/125* (2013.01);
(Continued)

(58) Field of Classification Search
CPC ..... B65H 5/06; B65H 5/062; B65H 5/068; B65H 5/36; B65H 29/00; B65H 29/12; B65H 29/125; B65H 29/14; B65H 29/20; B65H 29/52; B65H 31/22; B65H 31/30; B65H 2401/213; B65H 2404/50; B65H 2402/5154; B65H 2515/71; B65H 2555/42; B65H 2801/24
See application file for complete search history.

(56) References Cited

U.S. PATENT DOCUMENTS 6,003,864 A * 12/1999 Kuo ..... B65H 5/062 271/188
6,259,888 B1 * 7/2001 Kazama ..... B65H 29/12 271/183
(Continued)

FOREIGN PATENT DOCUMENTS

JP 2010-85431 A 4/2010

*Primary Examiner* — Prasad Gokhale
(74) *Attorney, Agent, or Firm* — Studebaker & Brackett PC

(57) ABSTRACT

An image forming apparatus includes an apparatus main body, a post-processing device, a first magnetic body, and a second magnetic body. The apparatus main body includes an ejecting part configured to eject a sheet toward an ejecting space. The post-processing device is configured to be slidable between an attached position and a detached position. The post-processing device includes a post-processing part and a movable guide. The movable guide is movable between an ordinary position and an opening position. The first magnetic body magnetically attracts the second magnetic body so as to hold the movable guide at the opening position, in a state where the post-processing device is shifted to the detached position. The first magnetic body separates from the second magnetic body and releases magnetic attraction to the second magnetic body when the post-processing device slides from the detached position to the attached position.

11 Claims, 10 Drawing Sheets

(51) Int. Cl.

| | |
|---|---|
| ***B65H 29/52*** | (2006.01) |
| ***B65H 29/14*** | (2006.01) |
| ***B65H 5/06*** | (2006.01) |
| ***B65H 29/12*** | (2006.01) |
| ***B65H 29/20*** | (2006.01) |

(52) U.S. Cl.
CPC ..... *B65H 29/14* (2013.01); *B65H 29/20* (2013.01); *B65H 29/52* (2013.01); *B65H 2402/5154* (2013.01); *B65H 2555/42* (2013.01); *B65H 2801/24* (2013.01)

(56) References Cited

U.S. PATENT DOCUMENTS

| | | | | |
|---|---|---|---|---|
| 2010/0314823 | A1* | 12/2010 | Terao | B65H 5/062 271/3.14 |
| 2010/0316425 | A1* | 12/2010 | Sasahara | B65H 5/062 399/410 |
| 2011/0215517 | A1* | 9/2011 | Mizutani | B65H 5/36 271/109 |
| 2015/0035226 | A1* | 2/2015 | Nishi | B65H 29/125 271/207 |

* cited by examiner

IMAGE FORMING APPARATUS

INCORPORATION BY REFERENCE

This application is based on and claims the benefit of priority from Japanese patent application No. 2015-142182 filed on Jul. 16, 2015, the entire contents of which are incorporated herein by reference.

BACKGROUND

The present disclosure relates to an image forming apparatus, such as a printer or an MFP (a multifunction peripheral).

An image forming apparatus may include a post-processing device which performs punching processing, staple processing or the like to a sheet (sheets) on which an image is formed. The post-processing device may be attached to an inside body space of an apparatus main body.

For example, there is an image forming apparatus including a sheet post-processing device slidably arranged at an inside body sheet ejecting space. When a sheet conveyance failure (a jam) occurs, a user slides the sheet post-processing device toward a sheet ejecting direction and detaches a connecting part of the sheet post-processing device and an image forming apparatus main body. The user puts a hand into a space formed between the sheet post-processing device and the image forming apparatus main body, and opens (or detaches) a guide plate at a side of the image forming apparatus main body. Then, the user removes the sheet jammed in vicinity of an ejecting part.

SUMMARY

In accordance with an embodiment of the present disclosure, an image forming apparatus includes an apparatus main body, a post-processing device, a first magnetic body, and a second magnetic body. The apparatus main body includes an ejecting part configured to eject a sheet, on which an image is formed, toward an ejecting space. The post-processing device is configured to be slidable at the ejecting space between an attached position to be adjacent to the ejecting part and a detached position to be more remote from the ejecting part than the attached position. The first magnetic body is arranged at the post-processing device. The second magnetic body is arranged at the apparatus main body so as to face the first magnetic body in a state where the post-processing device is shifted to the detached position. The post-processing device includes a post-processing part and a movable guide. The post-processing part is configured to perform post-processing to the sheet on which the image is formed. The movable guide is configured to compose a conveying path which communicates the ejecting part and the post-processing part. The movable guide is configured to be movable between an ordinary position to compose the conveying path and an opening position to open the conveying path. The first magnetic body is configured to magnetically attract the second magnetic body so as to hold the movable guide at the opening position, in the state where the post-processing device is shifted to the detached position. The first magnetic body is configured to separate from the second magnetic body and to release magnetic attraction to the second magnetic body when the post-processing device slides from the detached position to the attached position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a preferred embodiment of the present disclosure will be explained with reference to attached drawings. Incidentally, hereinafter, a near side in FIGS. 1, 6, and 7 will be set as a front side, and explanations will be given based on directions shown in each figure. Incidentally, in the following explanation, a term "conveying direction" indicates a conveying direction of sheets S, and a term "width direction" indicates a width direction of the sheets S, the width direction being orthogonal to the conveying direction. Further, terms, such as "upstream", "downstream", or the like, indicate "upstream", "downstream" in the conveying direction, or the like.

Figure 1:
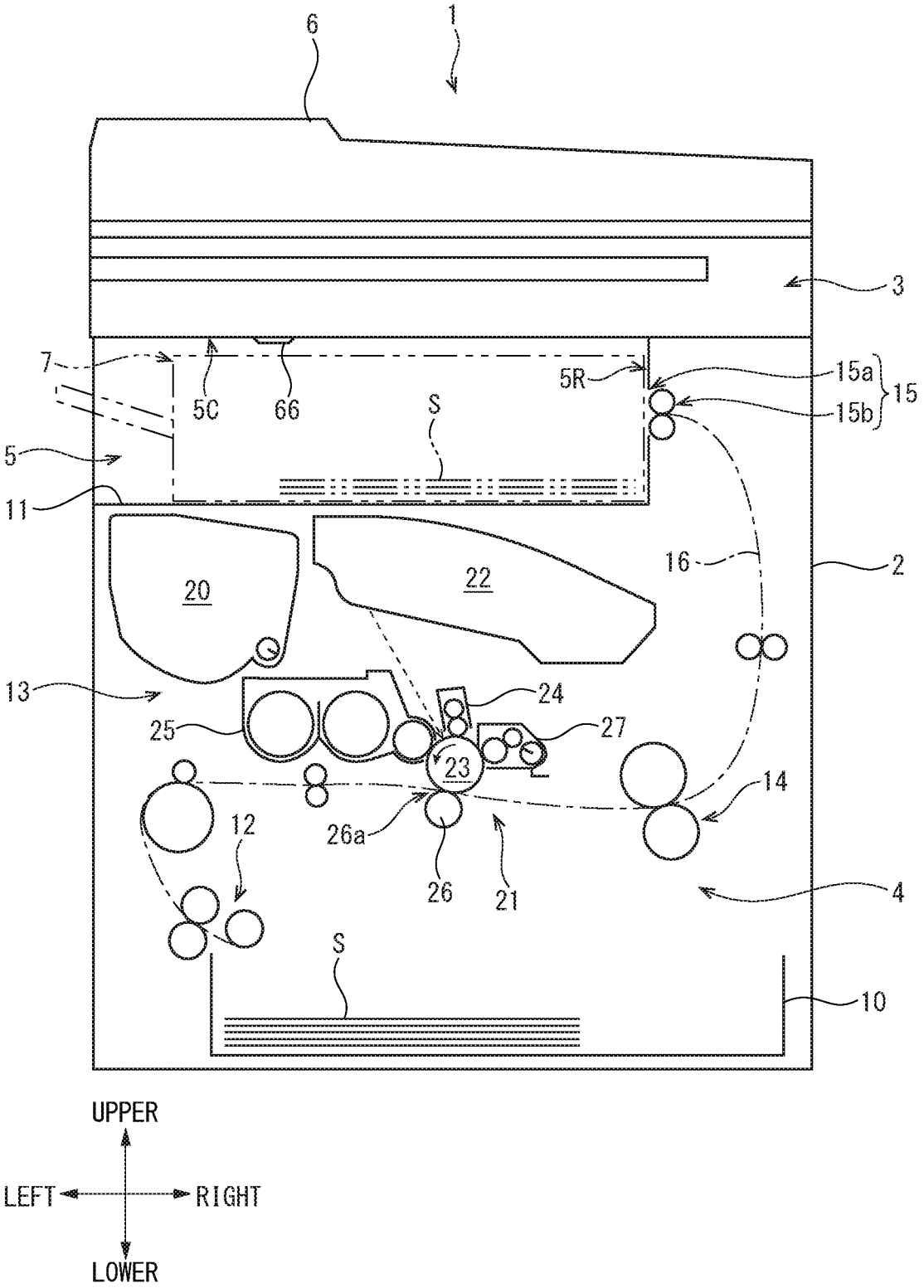
FIG. 1 is a sectional view schematically showing an internal structure of an MFP according to an embodiment of the present disclosure.

An MFP 1 (a multifunction peripheral) as an image forming apparatus according to the present embodiment will be explained with reference to FIG. 1. FIG. 1 is a sectional view schematically showing an internal structure of the MFP 1.

The MFP 1 is configured to include an apparatus main body 2, an image reading part 3 and an image forming part 4. The apparatus main body 2 is formed in a nearly cuboid shape to form an exterior of the MFP 1. The image reading part 3 is arranged in an upper part of the apparatus main body 2, and the image forming part 4 is arranged in a lower part of the apparatus main body 2. Between the image reading part 3 and the image forming part 4, an inside body space 5 as an ejecting space is formed by hollowing out the apparatus main body 2 from a left side. The inside body space 5 is formed inside the apparatus main body 2 as a space formed in a nearly cuboid shape elongated in a left and right direction. A front face and a left face of the inside body space 5 are opened.

The image reading part 3 is configured to include an element (not shown) which optically reads document image information. Above the image reading part 3, an automatic document feeder 6 is mounted. The automatic document feeder 6 is arranged to convey a document toward a reading position of the image reading part 3. Incidentally, the image reading part 3 and the automatic document feeder 6 have common structures, and therefore will not be explained in detail.

The image forming part 4 includes a feeding cassette 10 and a stacking tray 11. The feeding cassette 10 is detachably attached to the lower part of the apparatus main body 2. Inside the feeding cassette 10, sheets S (a bundle of sheets S) are contained. The stacking tray 11 is formed as a bottom face of the inside body space 5. On the stacking tray 11, the sheets S on which images are formed are stacked. Incidentally, the sheets S are not limited to sheets made of paper and may be made of resin films or the like.

The image forming part 4 includes a feeding part 12, an image forming unit 13, a fixing device 14, and an ejecting part 15. The feeding part 12 is arranged at an upstream end part of a main body conveying path 16 extending from the feeding cassette 10 to the stacking tray 11. The image forming unit 13 is arranged at an intermediate part of the main body conveying path 16. The fixing device 14 is arranged at a downstream side part of the main body conveying path 16. The ejecting part 15 is arranged at a downstream end part of the main body conveying path 16.

The image forming unit 13 is configured to include a toner container 20, a drum unit 21, and an optical scanning device 22. The toner container 20 and the optical scanning device 22 are arranged below the stacking tray 11. The drum unit 21 is arranged below the optical scanning device 22.

The toner container 20 contains a black toner (a developer), for example. The drum unit 21 is configured to include a photosensitive drum 23, a charging device 24, a developing device 25, a transfer roller 26, and a cleaning device 27. The photosensitive drum 23 is driven to rotate around an axis extending in a front and rear direction. The charging device 24, the developing device 25, the transfer roller 26, and the cleaning device 27 are arranged around the photosensitive drum 23 in a transfer process order. The transfer roller 26 comes into pressure contact with the photosensitive drum 23 from a lower side so as to form a transfer nip part 26*a*.

The ejecting part 15 is arranged at the apparatus main body 2 so as to eject the sheets S, on which the images are formed, toward the inside body space 5. The ejecting part 15 includes an ejecting port 15*a* and a pair of ejecting rollers 15*b*. The ejecting port 15*a* is opened to a right side face 5R which composes the inside body space 5. The ejecting port 15*a* communicates an inside of the apparatus main body 2 and the inside body space 5. A pair of the ejecting rollers 15*b* are arranged at an inner side of the ejecting port 15*a*. A pair of the ejecting rollers 15*b* rotate while nipping the sheets S so as to eject the sheets S from the ejecting port 15*a* toward the inside body space 5.

Hereinafter, an operation of the image forming part 4 of the MFP 1 will be described. A control device (not shown) which controls the MFP 1 makes the image forming part 4 perform following image formation processing based on image data read by the image reading part 3 or image data transmitted from a personal computer or the like.

The charging device 24 charges a surface of the photosensitive drum 23. The optical scanning device 22 performs exposure (see a broken arrow in FIG. 1) to the photosensitive drum 23 corresponding to the image data. The developing device 25 develops an electrostatic latent image formed on the surface of the photosensitive drum 23 to a toner image. Meanwhile, the feeding part 12 feeds the sheets S from the feeding cassette 10 toward the main body conveying path 16. The sheets S are conveyed in the main body conveying path 16 and reach the transfer nip part 26*a*. The transfer roller 26 to which a transfer bias is applied transfers the toner image to the sheets S passing through the transfer nip part 26*a*. The fixing device 14 heats the sheets S while pressuring the sheets S, and fixes the toner image to the sheets S. After fixing processing, the sheets S are ejected from the ejecting port 15*a* to the stacking tray 11. The cleaning device 27 removes a toner left on the surface of the photosensitive drum 23 after transferring processing.

By the way, in some cases, the MFP 1 includes a post-processing device 7 which performs post-processing, such as staple processing, to the sheet s (a bundle of the sheets S) on which the images are formed. The post-processing device 7 is detachably attached to the inside body space 5 of the apparatus main body 2.

Figure 2:
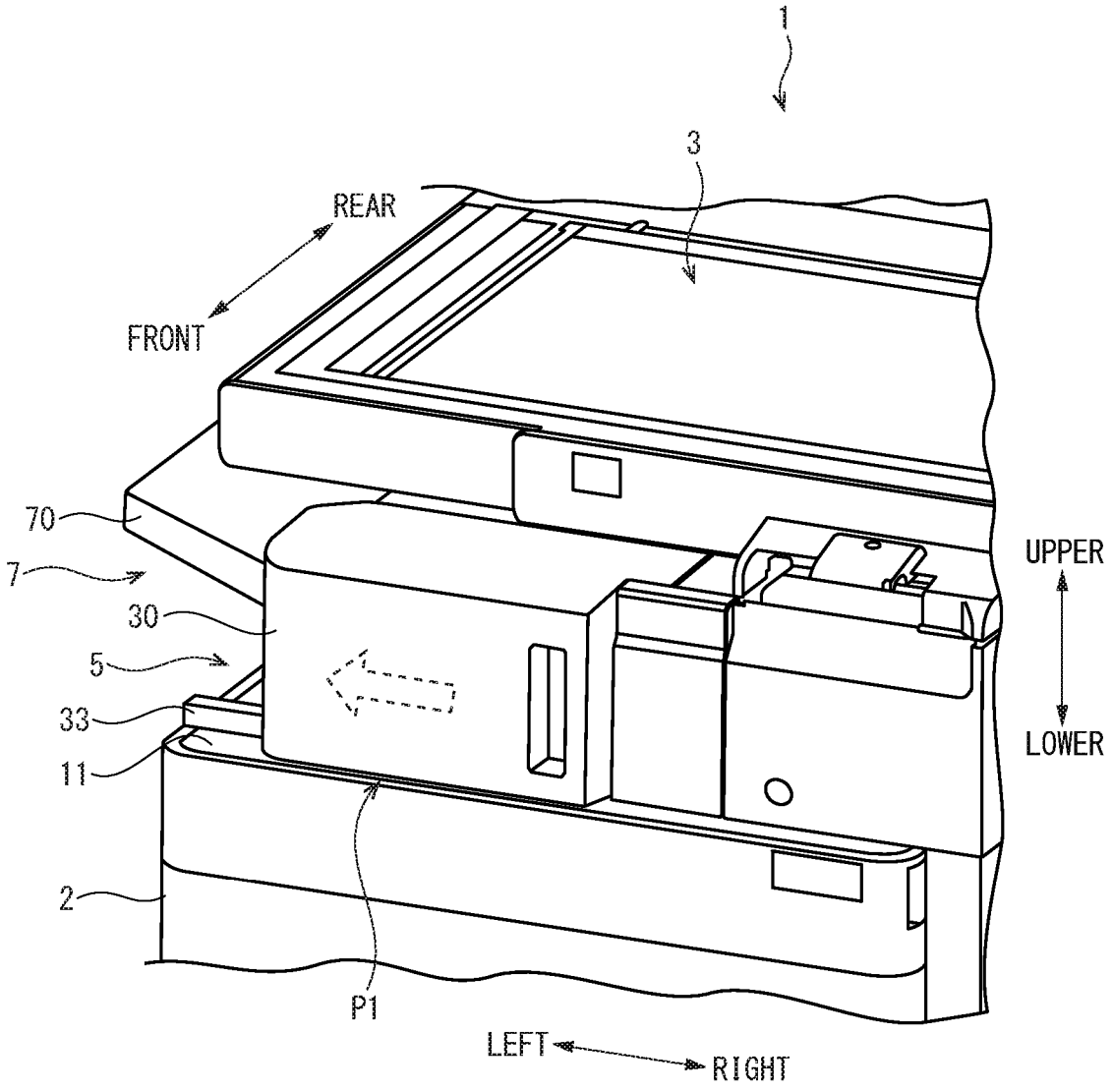
FIG. 2 is a perspective view showing a post-processing device attached to an inside body space of the MFP according to the embodiment of the present disclosure.
Figure 3:
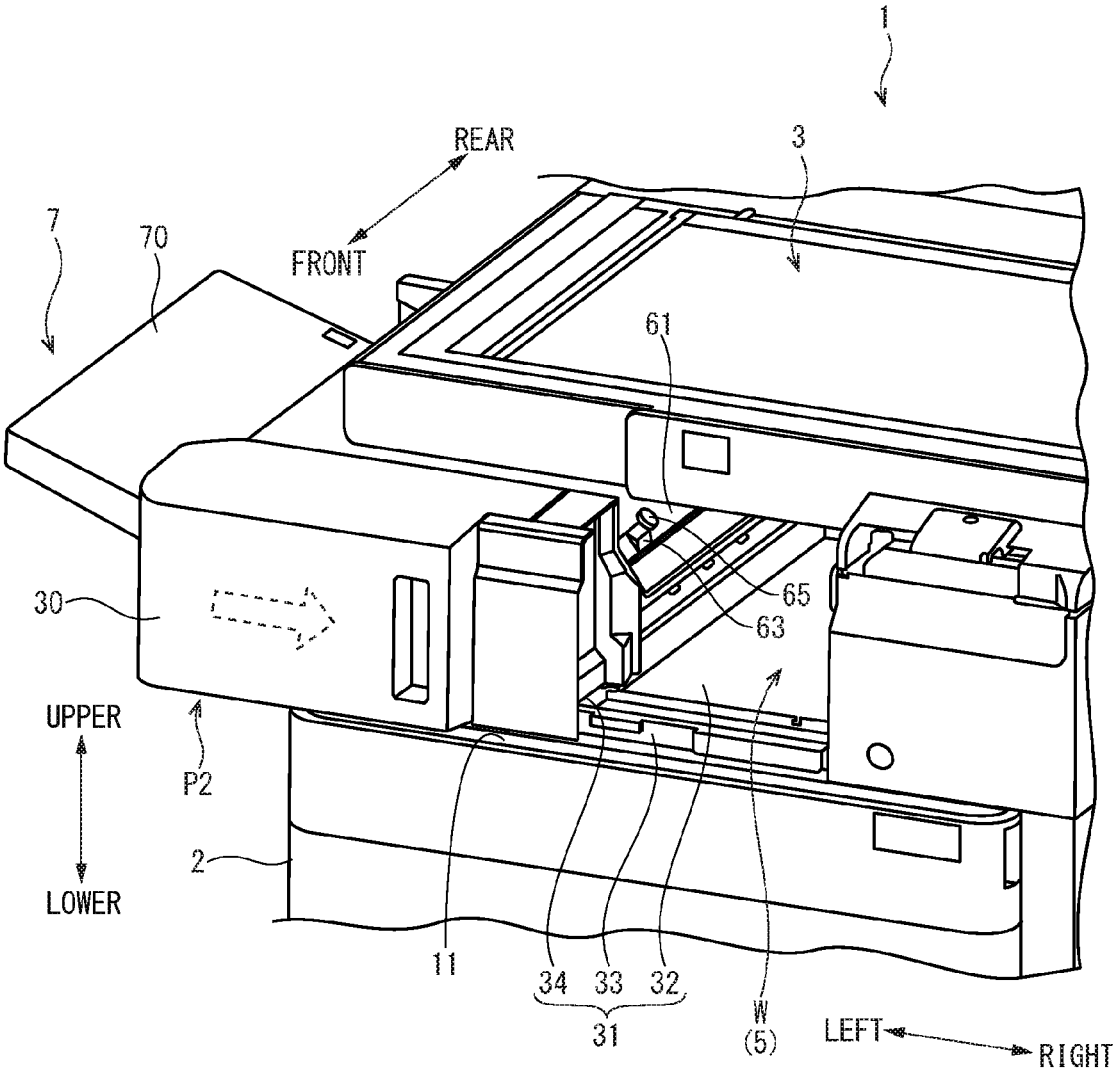
FIG. 3 is a perspective view showing the post-processing device drawn from the inside body space of the MFP according to the embodiment of the present disclosure.
Figure 4:
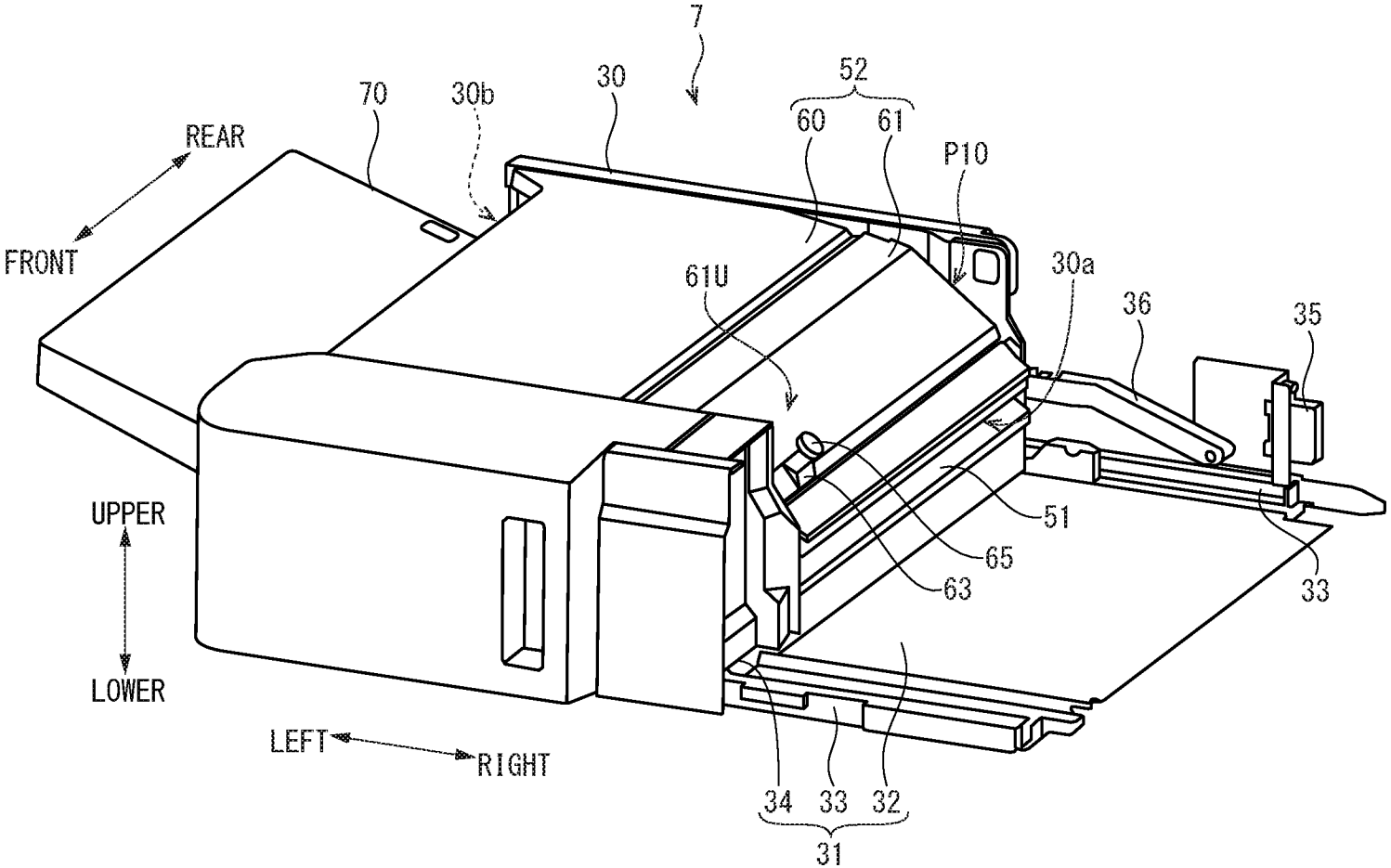
FIG. 4 is a perspective view showing a state where an upper side movable guide of the post-processing device is closed, according to the embodiment of the present disclosure.
Figure 5:
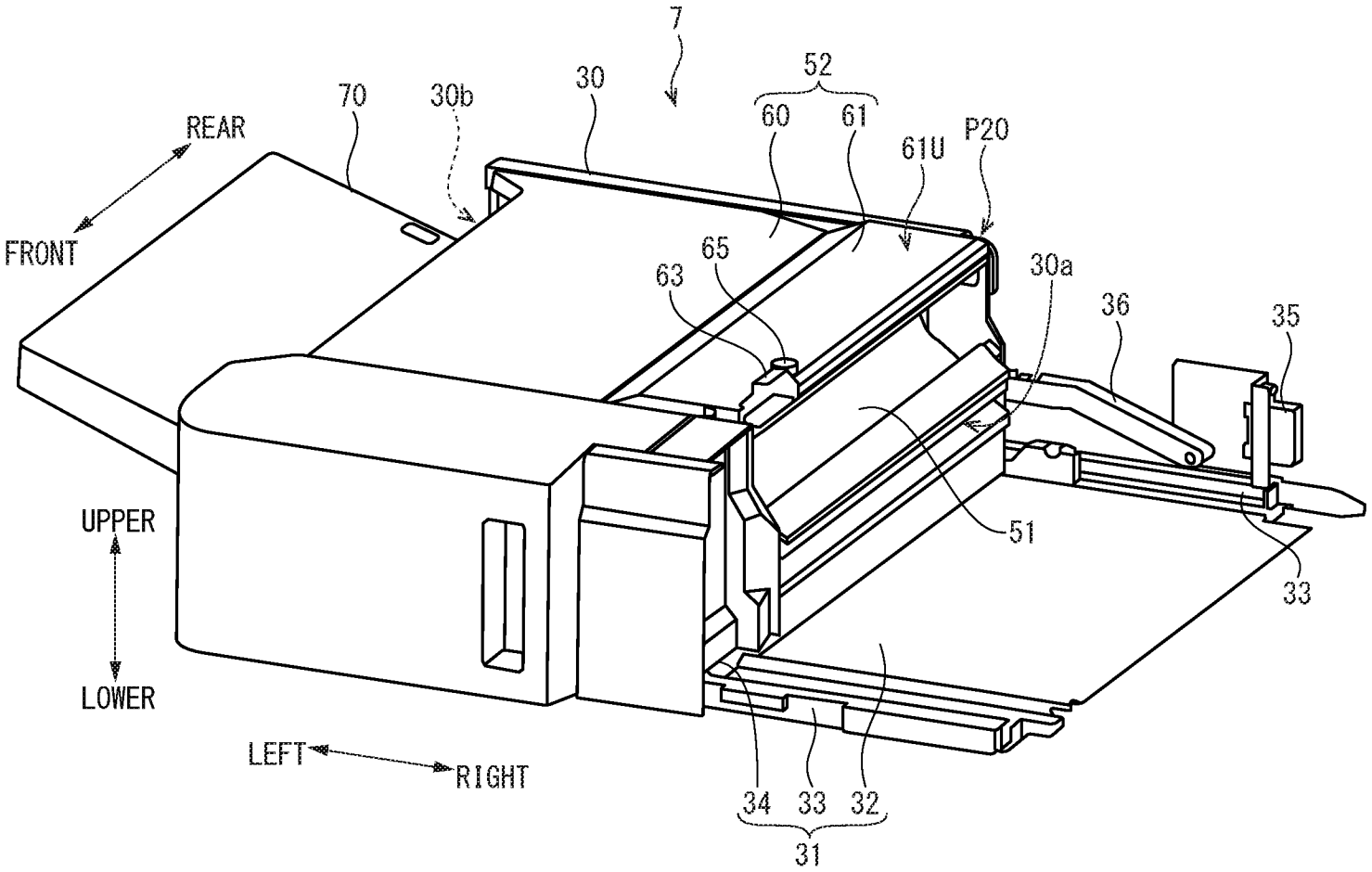
FIG. 5 is a perspective view showing a state where the upper side movable guide of the post-processing device is opened, according to the embodiment of the present disclosure.
Figure 6:
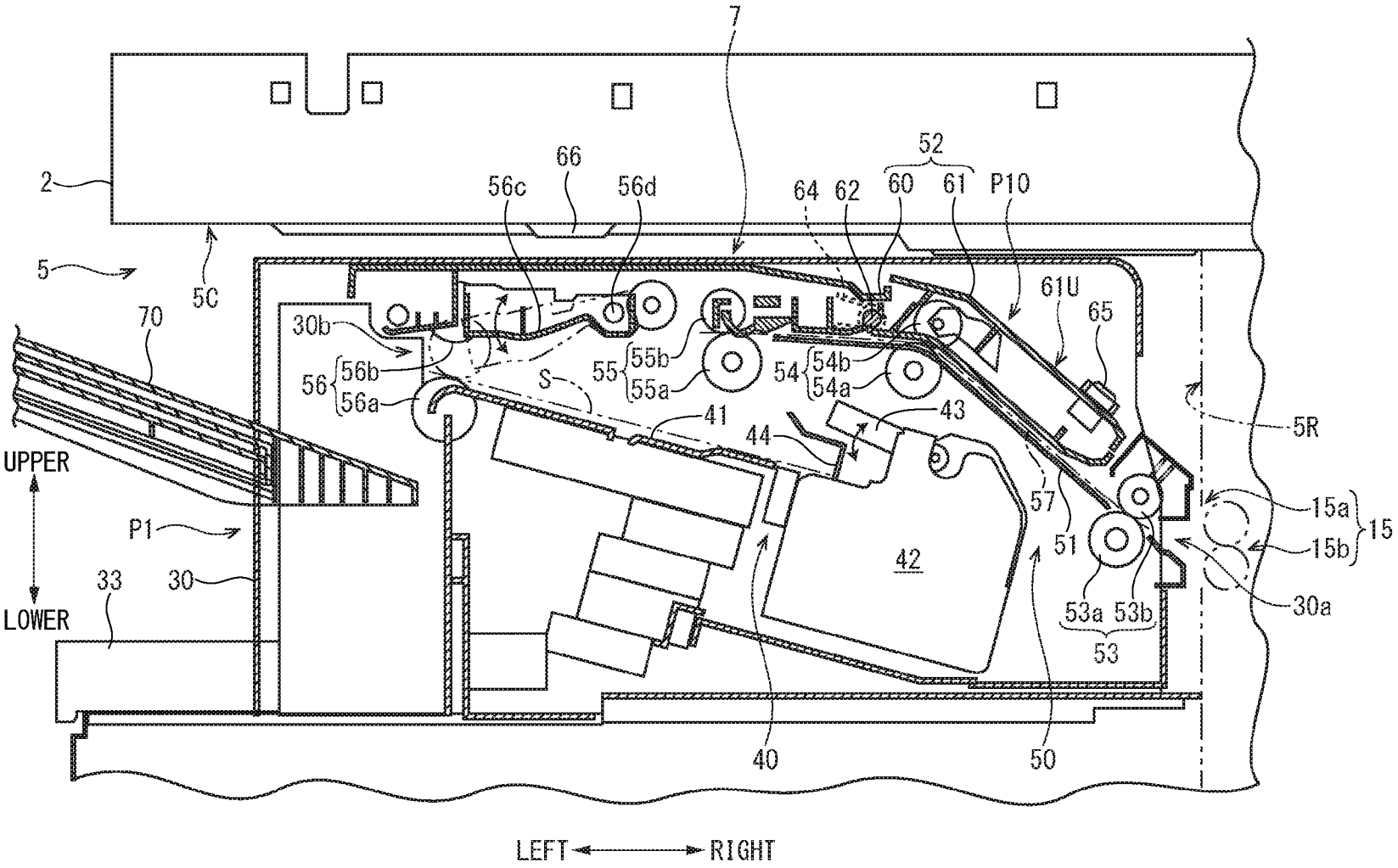
FIG. 6 is a sectional view showing the state where the upper side movable guide of the post-processing device is closed, according to the embodiment of the present disclosure.
Figure 7:
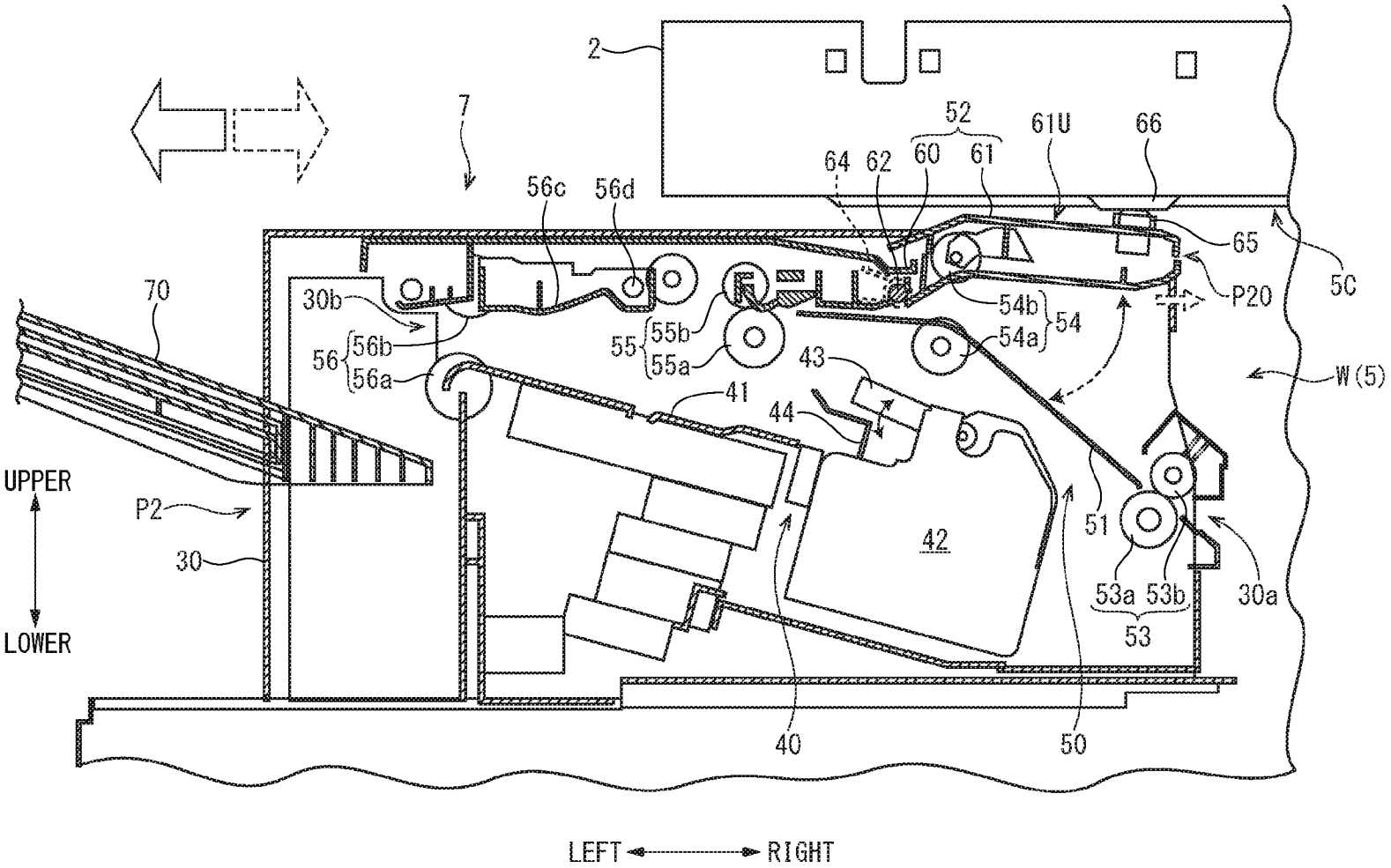
FIG. 7 is a sectional view showing the state where the upper side movable guide of the post-processing device is opened, according to the embodiment of the present disclosure.

Hereinafter, the post-processing device 7 will be described with reference to FIGS. 2 to 7. FIG. 2 is a perspective view showing the post-processing device 7 attached to the inside body space 5. FIG. 3 is a perspective view showing the post-processing device 7 drawn from the inside body space 5. FIG. 4 is a perspective view showing a state where an upper side movable guide 61 of the post-processing device 7 is closed. FIG. 5 is a perspective view showing a state where the upper side movable guide 61 of the post-processing device 7 is opened. FIG. 6 is a sectional view showing the state where the upper side movable guide 61 of the post-processing device 7 is closed. FIG. 7 is a sectional view showing the state where the upper side movable guide 61 of the post-processing device 7 is opened.

As shown in FIGS. 2 and 3, the post-processing device 7 includes a housing 30 of a nearly cuboid shape elongated in the left and right direction. As shown in FIGS. 3 and 4, the housing 30 is arranged inside the inside body space 5 via a slide guide part 31. The slide guide part 31 supports the housing 30 so that the housing 30 is slidable in the left and right direction. Incidentally, at one side (a right side) of the housing 30, a carry-in port 30*a* is opened, and, at the other side (a left side) of the housing 30, a carry-out port 30*b* is opened (see FIG. 4).

The slide guide part 31 includes a support plate 32, a pair of front and rear slide rails 33 and a pair of front and rear sliders 34.

The support plate 32 is made of a sheet metal, for example, and is formed in a rectangular shape when seen from a plan view. A pair of the front and rear slide rails 33 are formed so as to be elongated in the left and right direction (a sliding direction of the housing 30), respectively. A pair of the front and rear slide rails 33 are fixed to both front and rear end parts of the support plate 32. The support plate 32 and each slide rail 33 are positioned and fixed on the stacking tray 11 (the bottom face which composes the inside body space 5). A pair of the front and rear sliders 34 are provided at both front and rear end parts of a lower face of the housing 30.

The housing 30 is arranged above the support plate 32 and each slide rail 33, and each slider 34 slidably engages with each slide rail 33 from an upper side. At the inside body space 5, the post-processing device 7 is arranged so as to be slidable between an attached position P1 to be adjacent to the ejecting part 15 (see FIGS. 2 and 6) and a detached position P2 to be more remote from the ejecting part 15 than the attached position P1 (see FIGS. 3 and 7). That is, in a state where the post-processing device 7 is at the attached position P1, the post-processing device 7 is adjacent to the ejecting part 15, and in a state where the post-processing device 7 is at the detached position P2, the post-processing device 7 is more remote from the ejecting part 15 than in the state where the post-processing device 7 is at the attached position P1. The post-processing device 7 (the housing 30) is usually used in a state where the post-processing device 7 is shifted to the attached position P1.

Incidentally, as shown in FIG. 4, at a right end part of the rear slide rail 33, a connector 35 is arranged. The connector 35 is electrically connected to an electrical component in the post-processing device 7 via a cable (not shown) held by a cable bear 36. At a rear part of the right side face 5R which composes the inside body space 5, a counterpart connector (not shown) connected to the connector 35 is arranged. When the connector 35 is connected to the counterpart connector, the post-processing device 7 is electrically connected to a power supply (not shown) and the control device arranged in the apparatus main body 2. Consequently, it is possible to supply power to the post-processing device 7, and to transmit electrical signals or the like to the post-processing device 7. Incidentally, although not shown, the cable bear 36 stretches and contracts in conjunction with the housing 30 which slides, so that the connector 35 maintains a state to be connected to the counterpart connector.

As shown in FIG. 6, the post-processing device 7 includes a post-processing part 40, a conveying guide part 50, and an ejecting tray 70 in the housing 30. The post-processing part 40 is arranged to perform staple processing as post-processing to the sheets S (a bundle of the sheets) on which the images are formed. The conveying guide part 50 is arranged to convey the sheets S from the ejecting part 15 toward the post-processing part 40. The ejecting tray 70 is extended from the carry-out port 30*b* of the housing 30 to an upper left direction.

The post-processing part 40 is configured to stack a plurality of sheets S and to bind them by a staple. The post-processing part 40 includes a processing tray 41 and a staple device 42.

The processing tray 41 is arranged so that the sheets which are subjected to the staple processing are put on the processing tray 41 temporarily. The processing tray 41 is arranged so as to be inclined downward from a left side to a right side. The staple device 42 includes a binding part 43 which pierces a predetermined number of the sheets S with the staple after end parts of the sheets S are aligned. The staple device 42 includes a reference fence 44 which comes into contact with and aligns right end parts of the sheets S.

The conveying guide part 50 includes a lower side guide member 51, an upper side guide member 52, a pair of carry-in rollers 53, a pair of first conveying rollers 54, a pair of second conveying rollers 55, and a pair of carry-out rollers 56. The lower side guide member 51 and the upper side guide member 52 compose a conveying path 57 which communicates the ejecting part 15 and the post-processing part 40. A pair of the carry-in rollers 53 and each pair of the conveying rollers 54 and 55 are configured to convey the sheets S, which have been conveyed from the ejecting part 15 to the conveying path 57, toward the post-processing part 40. A pair of the carry-out rollers 56 are configured to eject the sheets S toward the ejecting tray 70. At an upstream end part of the conveying path 57, the above-mentioned carry-in port 30*a* is opened.

The lower side guide member 51 is fixed to and arranged in the housing 30 (see FIG. 5). The lower side guide member 51 is extended from the carry-in port 30*a* to the upper left direction. The lower side guide member 51 is arranged so as to cover an upper side of the staple device 42. The lower side guide member 51 is arranged at a lower side of the upper side guide member 52 (the upper side movable guide 61) so as to face the upper side guide member 52 via the conveying path 57.

The upper side guide member 52 composes an upper face of the housing 30 (see FIG. 4). The upper side guide member 52 includes an upper side fixed guide 60 and an upper side movable guide 61. The upper side fixed guide 60 is arranged nearly horizontally at a downstream side of the upper side movable guide 61. The upper side fixed guide 60 is fixed to and arranged in the housing 30. The upper side movable guide 61 is inclined upward from the right side to the left side. At a downstream end part of the upper side movable guide 61, a pair of rotation shafts 62 are protruded from both front and rear side faces. A pair of the front and rear rotation shafts 62 are axially supported by the housing 30, and rotatably support the upper side movable guide 61.

The upper side movable guide 61 rotates around the rotation shafts 62 toward an upper and lower direction. In more detail, the upper side movable guide 61 is configured to rotate (move) between an ordinary position P10 to compose the conveying path 57 (see FIGS. 4 and 6) and an opening position P20 (see FIGS. 5 and 7) to open the conveying path 57. The opening position P20 is set above the ordinary position P10.

As shown in FIGS. 4 and 5, at a right front end part of the upper side movable guide 61, an unlocking lever 63 for operating a locking mechanism (not shown) is arranged. The locking mechanism is arranged to hold (lock) the upper side movable guide 61 at the ordinary position P10. As shown in FIG. 5, a lock is released by pulling up the unlocking lever 63 and it becomes possible to rotate the upper side movable guide 61.

As shown in FIG. 6, around each rotation shaft 62, a torsion coil spring 64 as a biasing member is wound. The torsion coil spring 64 biases the upper side movable guide 61 toward the ordinary position P10 (downward).

As shown in FIGS. 4 to 6, on an upper face 61U (outer face) of the upper side movable guide 61, a magnet 65 as a first magnetic body is arranged. The magnet 65 is fixed to a front side part of the upper side movable guide 61 by an adhesive or a method like screwing. The magnet 65 is a permanent magnet, and is made of a casted magnet which includes iron, chrome and cobalt as main components, for example.

Meanwhile, as shown in FIGS. 6 and 7, the apparatus main body 2 includes a magnetic attracting part 66 as a second magnetic body corresponding to the magnet 65. The magnetic attracting part 66 is protruded from a ceiling face 5C, which composes the inside body space 5, toward an inside of the inside body space 5 (downward) so as to come into close contact with the magnet 65. Parts composing the ceiling face 5C of the inside body space 5 and the magnetic attracting part 66 in the apparatus main body 2 are made of a metal material, such as iron. The magnetic attracting part 66 is formed integrally with the ceiling face 5C by a press working, for example. As shown in FIG. 7, the magnetic attracting part 66 is arranged at the apparatus main body 2 (ceiling face 5C) so as to face the magnet 65 in a state where the post-processing device 7 is shifted to the detached position P2.

As shown in FIG. 6, a pair of the carry-in rollers 53 are arranged at an upstream end part of the conveying path 57 (near the carry-in port 30*a*). A pair of the first conveying rollers 54 are arranged at an intermediate part of the conveying path 57. A pair of the second conveying rollers 55 are arranged at a downstream end part of the conveying path 57 (above the processing tray 41).

Driving rollers 53*a* to 55*a* of a pairs of rollers 53 to 55 are arranged at a side of the lower side guide member 51 and are rotatably supported by the housing 30. Each driving roller 53*a* to 55*a* receives driving force of a driving motor (not shown) and rotates. A driven roller 53*b* of a pair of the carry-in rollers 53 is rotatably supported by the housing 30 at a side closer to an upstream side than an upstream end part of the upper side movable guide 61. A driven roller 54*b* of a pair of the first conveying rollers 54 is rotatably supported by a downstream end part of the upper side movable guide 61, and a driven roller 55*b* of a pair of the second conveying rollers 55 is rotatably supported by an upstream end part of the upper side fixed guide 60. Each driven roller 53*b* to 55*b* comes into pressure contact with and is driven to rotate with each corresponding driving roller 53*a* to 55*a*.

A pair of the carry-out rollers 56 are arranged near the carry-out port 30*b*. A driving roller 56*a* of a pair of the carry-out rollers 56 is rotatably supported by a downstream end part of the processing tray 41. The driving roller 56*a* receives the driving force of the driving motor and rotates. A driven roller 56*b* of a pair of the carry-out rollers 56 is rotatably supported by an arm 56*c* arranged above the processing tray 41. The arm 56*c* is configured to rotate around a support shaft 56*d* in the upper and lower direction. When the arm 56*c* rotates, the driven roller 56*b* rotates between a position to come into pressure contact with the driving roller 56*a* (see a two-dot chain line in FIG. 6), and a position to separate from the driving roller 56*a* (see a solid line in FIG. 6).

Hereinafter, a function of the post-processing device 7 will be described with reference to FIG. 6. The control device makes the post-processing device 7 perform the staple processing based on an instruction inputted by a user.

The sheets S on which the images are formed are conveyed to the conveying path 57 from the ejecting part 15 via the carry-in port 30*a*. Pairs of the rollers 53 to 55 arranged in the conveying path 57 rotate while nipping the sheets S and send the sheets S toward the processing tray 41, respectively. At this time, the driven roller 56*b* of a pair of the carry-out rollers 56 is separated from the driving roller 56*a*, and therefore the sheets S are placed on the processing tray 41 without being ejected to the ejecting tray 70. The sheets S placed on the processing tray 41 are gathered toward the staple device 42 by an operation of an aligning part which is not shown, and come into contact with the reference fence 44. The staple device 42 (binding part 43) binds a bundle of the sheets S by the staple (performs the staple processing) after the end parts of the sheets S are aligned and the sheets are stacked.

After the staple processing is performed, the arm 56*c* rotates downward around the support shaft 56*d*, and the driven roller 56*b* comes into pressure contact with the driving roller 56*a* so as to nip the sheets S (a bundle of the sheets). A pair of the carry-out rollers 56 rotate while nipping the sheets S (a bundle of the sheets) and eject the sheets S (a bundle of the sheets) toward the ejecting tray 70. The sheets S (A bundle of the sheets) are ejected from the carry-out port 30*b* to the ejecting tray 70.

Meanwhile, in a case where the staple processing is not performed, the driven roller 56*b* of a pair of the carry-out rollers 56 comes into pressure contact with the driving roller 56*a*, and the sheets S having been conveyed along the conveying path 57 are ejected toward the ejecting tray 70 by a pair of the carry-out rollers 56. As mentioned above, on the ejecting tray 70, the sheets S on which the images are formed and the sheets S to which the staple processing (the post-processing) is performed at the post-processing part 40 are ejected.

By the way, there is a case where, near the ejecting part 15 (carry-in port 30*a*) or on the conveying path 57, a conveyance failure of the sheets S (so-called a jam of the sheets) occurs. Next, jamming processing of the post-processing device 7 will be described with reference mainly to FIG. 7.

When the jam occurs, a user slides the housing 30 (the post-processing device 7) toward the conveying direction (a left side) along each slide rail 33 (see FIG. 3). When the housing 30 is slid from the attached position P1 to the detached position P2, between the right side face 5R of the inside body space 5 (the ejecting part 15) and the housing 30, a working space W for performing the jamming processing is formed (see FIG. 3). Via this working space W, a part of the upper side movable guide 61 is exposed to an outside of the MFP 1.

Subsequently, the user puts a hand in the working space W made by pulling the housing 30 away from the ejecting part 15 and opens the conveying path 57. In more detail, the user unlocks the upper side movable guide 61 by operating the unlocking lever 63, and rotates the upper side movable guide 61 upward against the biasing force of the torsion coil spring 64 (see FIG. 5). As shown in FIG. 7, when the upper side movable guide 61 is rotated from the ordinary position P10 to the opening position P20, the magnet 65 arranged at the upper side movable guide 61 magnetically comes into close contact with the magnetic attracting part 66 protruded from the ceiling face 5C of the inside body space 5. At this time, the upper side movable guide 61 is held at the opening position P20 by magnetic attracting force working between the magnet 65 and the magnetic attracting part 66. When the upper side movable guide 61 is shifted to the opening position P20, an upper side of the lower side guide member 51 is exposed (see FIG. 5). Consequently, it is possible to maintain a state where the conveying path 57 is opened, and easily remove the sheets S jammed in the ejecting part 15 or on the conveying path 57. Incidentally, when the upper side movable guide 61 is shifted to the opening position P20, the driven roller 54*b* of a pair of the first conveying rollers 54 separates from the driving roller 54*a*.

Subsequently, after the jammed sheets are removed, the user slides the housing 30 (the post-processing device 7) in an opposite conveying direction (right side (see a broken line arrow in FIG. 7)) in a state where the upper side movable guide 61 is held at the opening position P20. When the housing 30 is slid from the detached position P2 to the attached position P1, the magnet 65 arranged at the post-processing device 7 also slides so as to separate from the magnetic attracting part 66 (a broken line arrow in FIG. 7). The magnet 65 coming into close contact with the magnetic attracting part 66 is detached from the magnetic attracting part 66 in a process of sliding the housing 30 from the detached position P2 to the attached position P1. That is, as the housing 30 (post-processing device 7) slides, a state where the magnet 65 comes into close contact with the magnetic attracting part 66 is released. Hence, the magnetic attracting force working between the magnet 65 and the magnetic attracting part 66 is weakened, and therefore a weight of the upper side movable guide 61 and the biasing force of the torsion coil spring 64 rotate (drop) the upper side movable guide 61 from the opening position P20 to the ordinary position P10 (see FIGS. 4 and 6). As mentioned above, only by sliding the post-processing device 7 from the detached position P2 to the attached position P1, it is possible to automatically return the upper side movable guide 61, which is shifted to the opening position P20, to the ordinary position P10. Incidentally, the upper side movable guide 61 does not rotate to an upper side from the opening position P20. Consequently, the magnet 65 having been detached from the magnetic attracting part 66 is prevented from coming into close contact with the ceiling face 5C of the inside body space 5.

In the above-mentioned MFP 1 according to the present embodiment, the magnet 65 magnetically attracts the magnetic attracting part 66 so as to hold the upper side movable guide 61 shifted to the opening position P20 in a state where the post-processing device 7 is shifted to the detached position P2. The magnet 65 separates from the magnetic attracting part 66 and releases magnetic attraction to the magnetic attracting part 66 in a process of sliding the post-processing device 7 from the detached position P2 to the attached position P1. When the magnetic attracting force working between the magnet 65 and the magnetic attracting part 66 is weakened, the upper side movable guide 61 automatically rotates from the opening position P20 to the ordinary position P10. Consequently, even if returning of the upper side movable guide 61 to the ordinary position P10 is forgotten, it is possible to return the post-processing device 7 to the attached position P1 without damaging the upper side movable guide 61. That is, by only returning the post-processing device 7 to the attached position P1, it is possible to return the upper side movable guide 61 to the ordinary position P10. Further, it is possible to prevent the conveyance failure of the sheets S (a recurrence of the jam) when the returning of the upper side movable guide 61 is forgotten.

Incidentally, when the user operates the unlocking lever 63 and shifts the upper side movable guide 61 to the opening position P20, the unlocking lever 63 is positioned at a side of the ceiling face 5C of the inside body space 5. Therefore, there is a case where the user cannot access the unlocking lever 63. In this case, for example, it is also possible to additionally provide a lever which is operated to return the upper side movable guide 61 to the ordinary position P10. In this regard, the MFP 1 according to the present embodiment does not need to directly rotate the upper side movable guide 61 and, consequently, it is possible to omit a lever or the like additionally.

Further, in the MFP 1 according to the present embodiment, the upper side movable guide 61 is biased by the torsion coil spring 64 and is held at the ordinary position P10. Consequently, the upper side movable guide 61 can form the conveying path 57 appropriately.

Incidentally, although the MFP 1 according to the present embodiment uses a so-called casted magnet as the magnet 65, the present disclosure is not limited to this. For example, the magnet 65 may be made of a flexible rubber magnet, such as a bond magnet or a plastic magnet. As mentioned above, by using a rubber magnet as the magnet 65, it is possible to buffer an impact caused when the magnet 65 comes into close contact with the magnetic attracting part 66.

Figure 8:
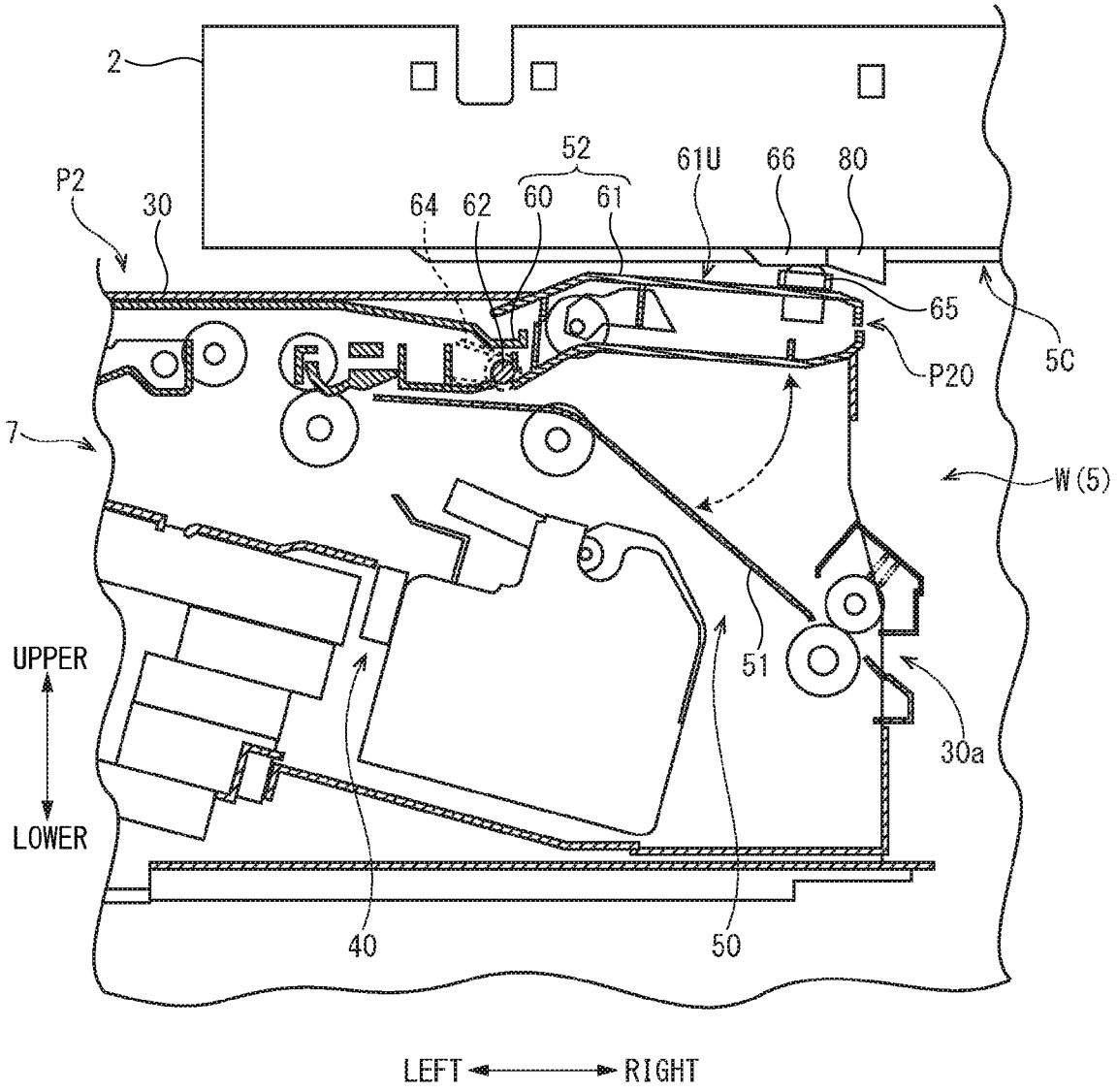
FIG. 8 is a sectional view showing a state where an upper side movable guide of a post-processing device is opened, according to a modification of the embodiment of the present disclosure.

Incidentally, although the MFP 1 according to the present embodiment includes the magnetic attracting part 66 which forms a nearly horizontal face, the present disclosure is not limited to this. According to a modified example, for example, as shown in FIG. 8, the magnetic attracting part 66 may be provided with an inclined member 80 formed so as to be inclined toward the side of the inside body space 5 (downward) along a direction from the detached position P2 to the attached position P1 (a right direction). The inclined member 80 may be made of a non-magnetic body, such as a synthetic resin, for example. According to this configuration, the magnet 65 cannot come into close contact with the magnetic attracting part 66 unless the post-processing device 7 (the housing 30) is drawn to the detached position P2. Consequently, the user can recognize that the post-processing device 7 (the housing 30) is not fully drawn to the detached position P2. Further, when the post-processing device 7 (the housing 30) is slid toward the attached position P1, the magnet 65 slides on the inclined member 80 and is detached from the ceiling face 5C with moving downward. Consequently, it is possible to easily detach the magnetic attracting part 66 from the magnet 65. Incidentally, in this case, the torsion coil spring 64 may not be provided.

Figure 9:
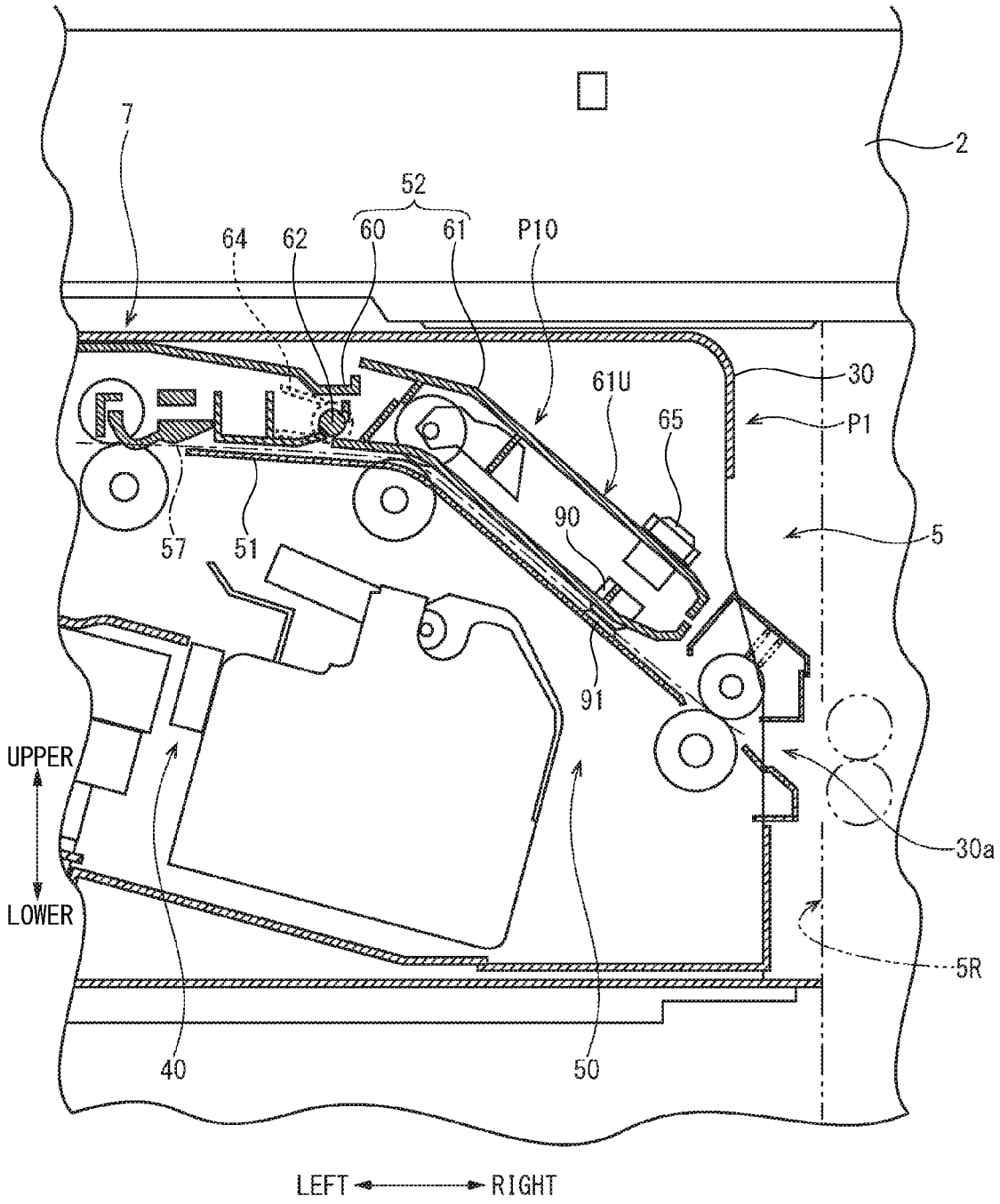
FIG. 9 is a sectional view showing a state where an upper side movable guide of a post-processing device is closed, according to another modification (1) of the embodiment of the present disclosure.
Figure 10:
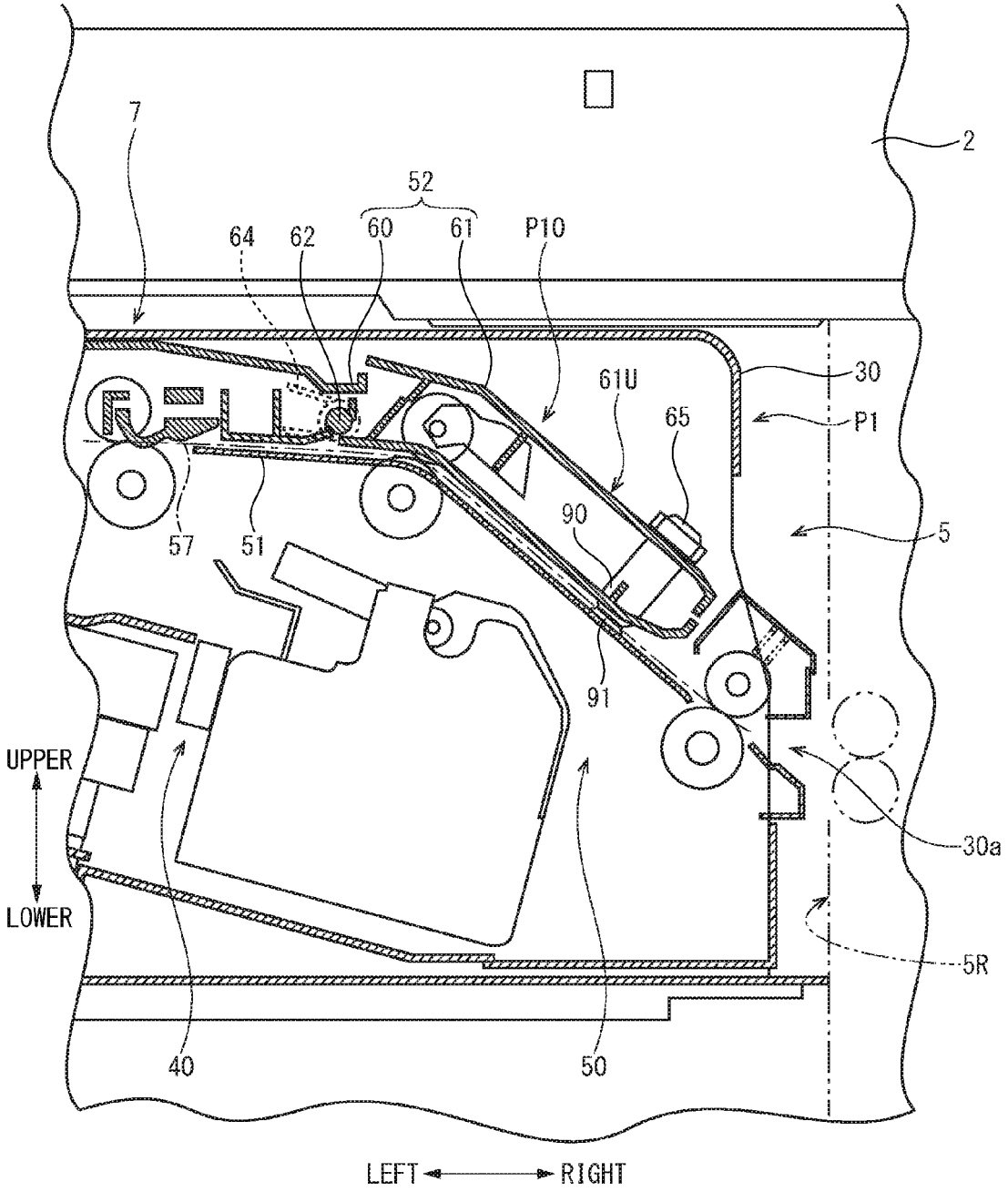
FIG. 10 is a sectional view showing a state where an upper side movable guide of a post-processing device is closed, according to another modification (2) of the embodiment of the present disclosure.

Incidentally, although the MFP 1 according to the present embodiment includes the magnet 65 which magnetically comes into close contact with the ceiling face 5C of the inside body space 5, the present disclosure is not limited to this. According to another modified example, for example, as shown in FIG. 9, the upper side movable guide 61 may include a locking magnet 90 as a third magnetic body arranged so as to face the lower side guide member 51. Meanwhile, the lower side guide member 51 may include a locking magnetic attracting part 91 as a fourth magnetic body arranged so as to face the locking magnet 90 in a state where the upper side movable guide 61 is shifted to the ordinary position P10. The locking magnet 90 magnetically attracts the locking magnetic attracting part 91 so as to hold the upper side movable guide 61 shifted to the ordinary position P10. The locking magnet 90 is a permanent magnet, and the locking magnetic attracting part 91 is made of metal, such as iron, on an upper face of the lower side guide member 51. The locking magnet 90 and the locking magnetic attracting part 91 are arranged at least one of both front and rear ends so as not to block conveyance of the sheets S. Consequently, the locking magnet 90 and the locking magnetic attracting part 91 function as a locking mechanism of the upper side movable guide 61, so that it is possible to hold the upper side movable guide 61 at the ordinary position P10. Incidentally, the locking magnet 90 may be formed integrally with the magnet 65 (see FIG. 10).

Incidentally, although, in the MFP 1 according to the present embodiment (including each modified example, the same applies likewise below), the magnet 65 (the locking magnet 90) is arranged at the post-processing device 7 (the upper side movable guide 61) and the magnetic attracting part 66 is arranged at the apparatus main body 2 (the locking magnetic attracting part 91 is arranged at the lower side guide member 51), the present disclosure is not limited to this. Although not shown, for example, the magnetic attracting part (the first magnetic body) made of metal may be arranged at the post-processing device 7 (the upper side movable guide 61), and the magnet (the second magnetic body) may be arranged at the apparatus main body 2. Similarly, the magnetic attracting part (the third magnetic body) made of metal may be arranged at the upper side movable guide 61, and the magnet (the fourth magnetic body) may be arranged at the lower side guide member 51. Further, for example, all of the first to fourth magnetic bodies may be made of magnets.

Incidentally, although the post-processing device 7 (the post-processing part 40) performs the staple processing as the post-processing to the sheets S, the present disclosure is not limited to this. For example, the post-processing part 40 may be configured to punch the sheets S instead of/in addition to the staple processing. Further, the post-processing part 40 may perform a function of folding the sheets S.

Incidentally, in the present embodiment, a case where the present disclosure is applied to the MFP 1 (monochrome type) is explained as an example. In other embodiment, the present disclosure may be applied to an image forming apparatus other than this, for example, a color printer, facsimile, or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

an apparatus main body including an ejecting part configured to eject a sheet, on which an image is formed, toward an ejecting space;

a post-processing device configured to be slidable at the ejecting space between an attached position to be adjacent to the ejecting part and a detached position to be more remote from the ejecting part than the attached position;

a first magnetic body arranged at the post-processing device; and a second magnetic body arranged at the apparatus main body so as to face the first magnetic body in a state where the post-processing device is shifted to the detached position, wherein the post-processing device includes:

a post-processing part configured to perform post-processing to the sheet on which the image is formed; and a movable guide configured to compose a conveying path which communicates the ejecting part and the post-processing part, and the movable guide is configured to be movable between an ordinary position to compose the conveying path and an opening position to open the conveying path, and the first magnetic body is configured to magnetically attract the second magnetic body so as to hold the movable guide at the opening position, in the state where the post-processing device is shifted to the detached position, and the first magnetic body is configured to separate from the second magnetic body and to release magnetic attraction to the second magnetic body when the post-processing device slides from the detached position to the attached position.

2. The image forming apparatus according to claim 1, wherein the ejecting space is an inside body space formed inside a body of the apparatus main body, and the opening position is set above the ordinary position, and the first magnetic body is arranged on an upper face of the movable guide, and the second magnetic body is protruded from a ceiling face of the inside body space toward an inside of the inside body space so as to come into close contact with the first magnetic body.

3. The image forming apparatus according to claim 2, wherein the second magnetic body is provided with an inclined member which is formed so as to be inclined toward a side of the inside body space along a direction from the detached position to the attached position.

4. The image forming apparatus according to claim 2, wherein the second magnetic body is formed integrally with the ceiling face.

5. The image forming apparatus according to claim 2, further comprising a slide rail arranged at a bottom face of the inside body space and formed so as to be elongated in a sliding direction of the post-processing device, wherein a slider configured to engage with the slide rail from an upper side is arranged on a lower face of the post-processing device.

6. The image forming apparatus according to claim 1, wherein at least one of the first magnetic body and the second magnetic body is made of a flexible rubber magnet.

7. The image forming apparatus according to claim 1, wherein the post-processing device further includes:

a rotation shaft configured to rotatably support the movable guide; and a biasing member configured to bias the movable guide toward the ordinary position.

8. The image forming apparatus according to claim 1, wherein the post-processing device further includes:

a lower side guide member arranged at a lower side of the movable guide so as to face the movable guide via the conveying path;

a pair of rollers configured to convey the sheet, which has been conveyed from the ejecting part to the conveying path, toward the post-processing part; and an ejecting tray where the sheet on which the image is formed and the sheet to which the post-processing is performed at the post-processing part are ejected.

9. The image forming apparatus according to claim 8, wherein the movable guide includes a third magnetic body arranged so as to face the lower side guide member, and the lower side guide member includes a fourth magnetic body arranged so as to face the third magnetic body in a state where the movable guide is shifted to the ordinary position, and the third magnetic body is configured to magnetically attract the fourth magnetic body so as to hold the movable guide at the ordinary position.

10. The image forming apparatus according to claim 9, wherein the third magnetic body is formed integrally with the first magnetic body.

11. The image forming apparatus according to claim 1, wherein when the post-processing device slides from the attached position to the detached position, a working space is formed between the ejecting part and the post-processing device and a part of the movable guide is exposed to an outside of the image forming apparatus via the working space.

* * * * *